US006270382B1

(12) United States Patent
Droesbeke et al.

(10) Patent No.: US 6,270,382 B1
(45) **Date of Patent: *Aug. 7, 2001**

(54) CONNECTOR FOR A SHIELDED CABLE

(75) Inventors: Gert Droesbeke, Nijlen; Eddy Creelle, Dendermonde; Jan Peter Karel Van Koetsem, Zwijndrecht, all of (BE)

(73) Assignee: Framatome Connectors International, Courbevoie (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/327,651

(22) Filed: Jun. 8, 1999

(30) Foreign Application Priority Data

Jun. 11, 1998 (NL) ..... 1009373

(51) Int. Cl.[7] ..... H01R 13/502
(52) U.S. Cl. ..... 439/701; 439/608; 439/686
(58) Field of Search ..... 439/701, 686, 439/607, 608, 108

(56) References Cited

U.S. PATENT DOCUMENTS 5,114,364 5/1992 Hunter ..... 439/497
5,525,066 * 6/1996 Morlion et al. ..... 439/701
5,613,882 * 3/1997 Hnatuck et al. ..... 439/686
5,795,191 * 8/1998 Preputnick et al. ..... 439/608
5,913,690 * 6/1999 Dechelette et al. ..... 439/608

FOREIGN PATENT DOCUMENTS 8501751 1/1987 (NL) .
WO 92/22943 12/1992 (WO) .
WO 97/47058 12/1997 (WO) .

* cited by examiner

*Primary Examiner*—Hien Vu
(74) *Attorney, Agent, or Firm*—Perman & Green, LLP

(57) ABSTRACT

A connector for a shielded cable comprises an assembly of at least two modules and electrical contact elements arranged in rows and columns. Each module is provided with a housing of insulating material and electrial contact elements received in the housing and arranged next to each other in side-by-side relationship. Each housing is mainly box-shaped with a front wall, a back wall, sidewalls lying therebetween, an upper side and a lower side. Channels extend between the upper and lower sides, which channels are separated from each other by intermediate walls, and the contact elements are received in the channels. One housing with its front wall joins the backwall of a next housing, wherein in each housing the front and back walls are provided with three corresponding supporting points, successive housings lying against each other with the supporting points, which supporting points determine the distance, laterally, between the contact elements of successive housings. At least one housing is provided with a shielding plate, mounted on the back wall thereof and leaving clear the supporting points of the back wall.

6 Claims, 6 Drawing Sheets

CONNECTOR FOR A SHIELDED CABLE

BACKGROUND OF THE INVENTION

1. Field of the Invention

The invention relates to a connector for a shielded cable, comprising an assembly of at least two modules and electrical contact elements arranged in rows and columns, wherein each module is provided with a housing of insulating material and electrical contact elements received in the housing and arranged next to each other in column direction, wherein each housing is mainly box-shaped with a front wall, a back wall, sidewalls lying therebetween, an upper side and a lower side, wherein channels extend between the upper and lower sides, said channels being separated from each other by intermediate walls, and the contact elements being received in said channels, wherein one housing with its front wall joins the back wall of a next housing.

2. Description of the Related Art

Such a connector is for example disclosed in U.S. Pat. No. 5,114,364. In this known connector the modules are lying against each other with front wall and back wall, so that the distance in row direction between successive contact elements is determined by the tolerances of the complete faces of front and back walls of the housing of each module.

BRIEF DESCRIPTION OF THE SEVERAL VIEWS OF THE DRAWINGS

The invention aims to provide an improved connector of the above-mentioned type, wherein the distance between contact elements in row direction can be determined with higher accuracy.

To this end the connector according to the invention is characterized in that in each housing the front and back walls are provided with three corresponding supporting points, successive housings lying against each other with said supporting points, said supporting points determining the distance in row direction between the contact elements of successive housing, wherein at least one housing is provided with a shielding plate, mounted on the back wall thereof and leaving clear the supporting points of the back wall.

Thereby a connector is obtained, wherein the distance between successive contact elements in row direction can be determined accurately by the three supporting points on front and back walls of the housing of each module.

The invention will be further explained by reference to the drawings, in which an embodiment of the connector of the invention is schematically shown.

Figure 1:
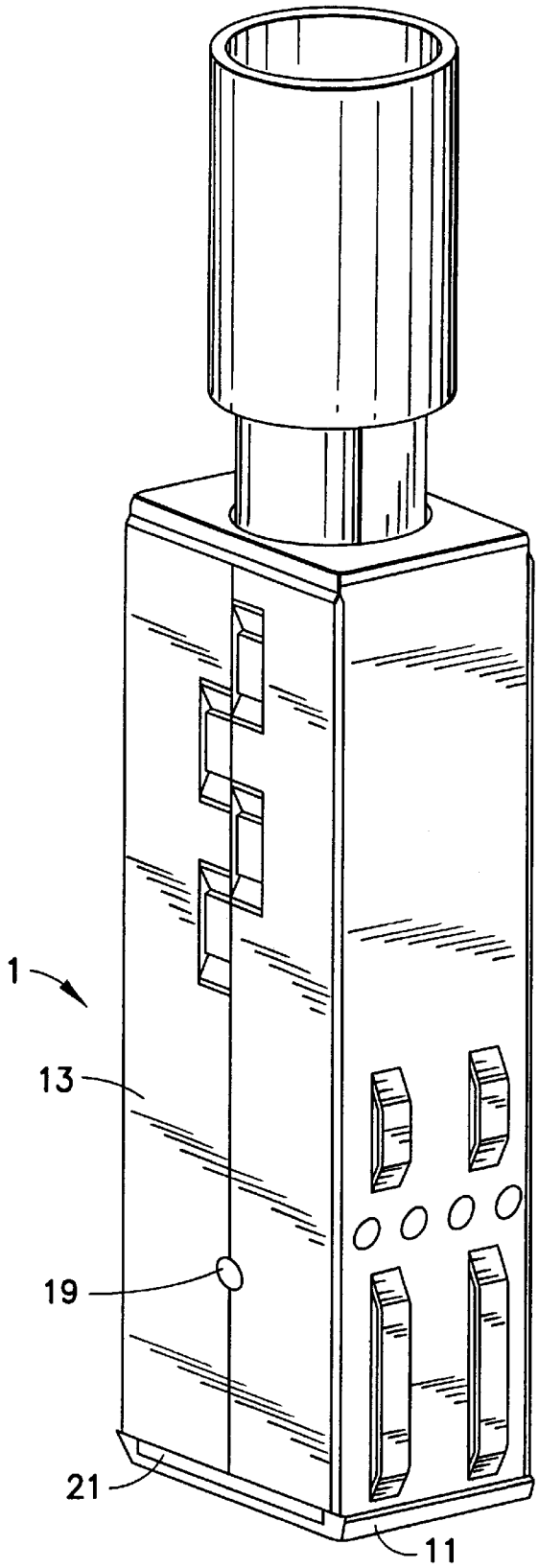

FIG. 1 is a perspective view of an embodiment of the connector of the invention as assembled.

Figure 2:
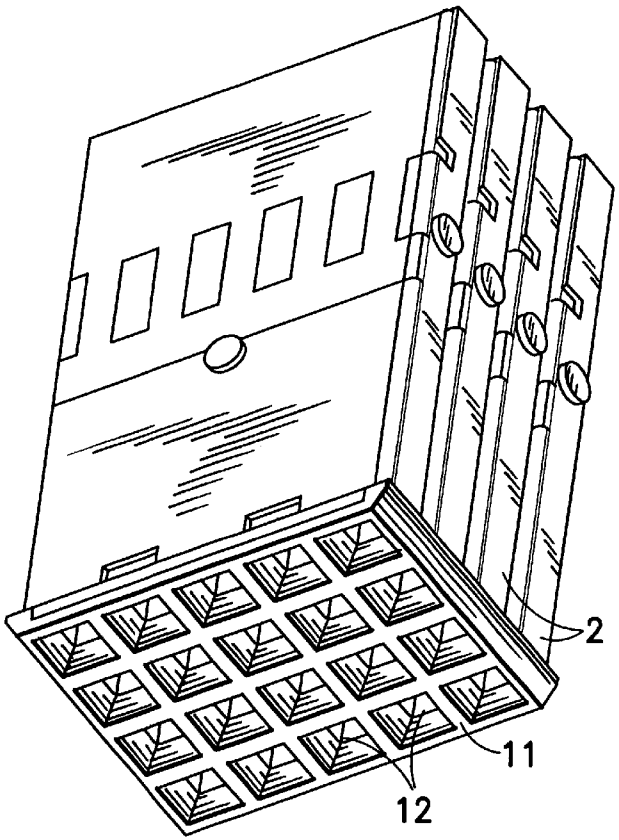

FIG. 2 is a perspective view of an assembly of four modules of the connector of FIG. 1.

Figure 3:
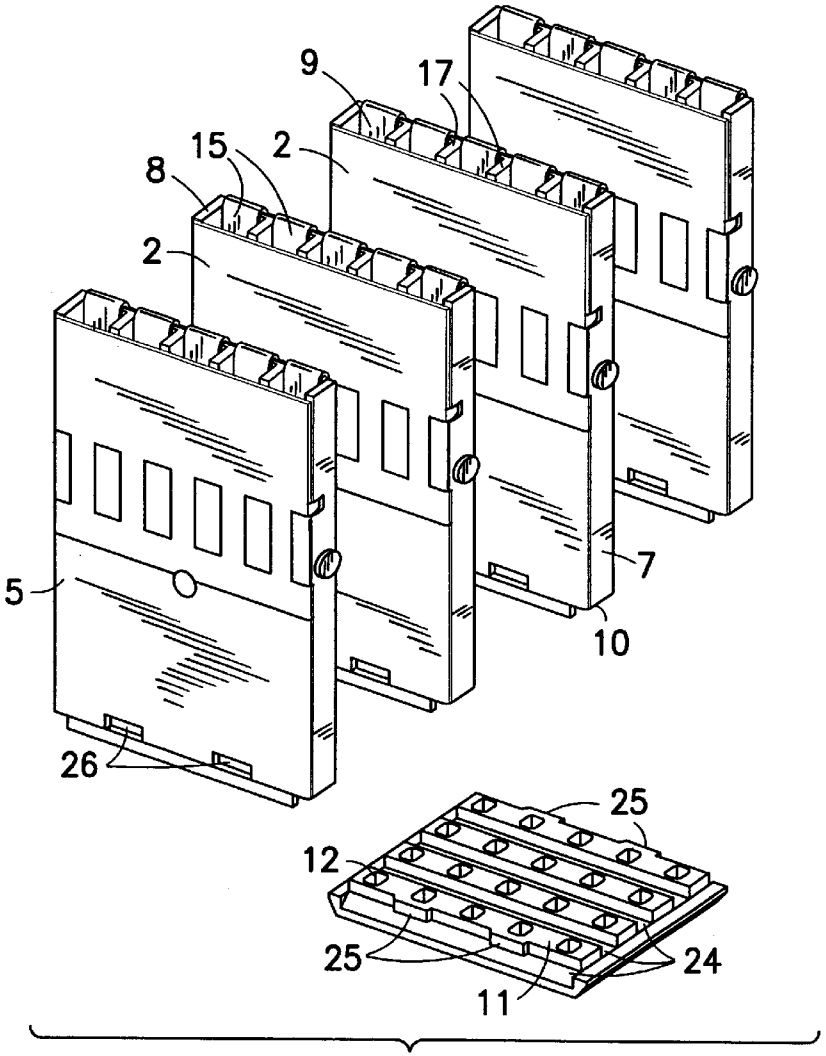

FIG. 3 shows the assembly of FIG. 2 as disassembled.

Figure 4:
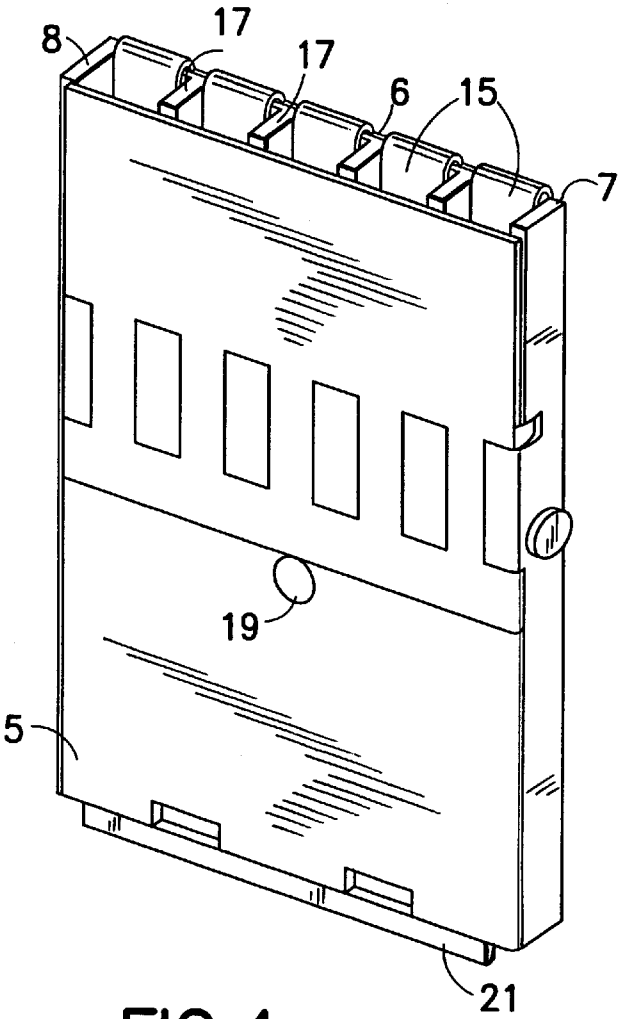

FIG. 4 is a perspective front view of a module of the connector of FIG. 1.

Figure 5:
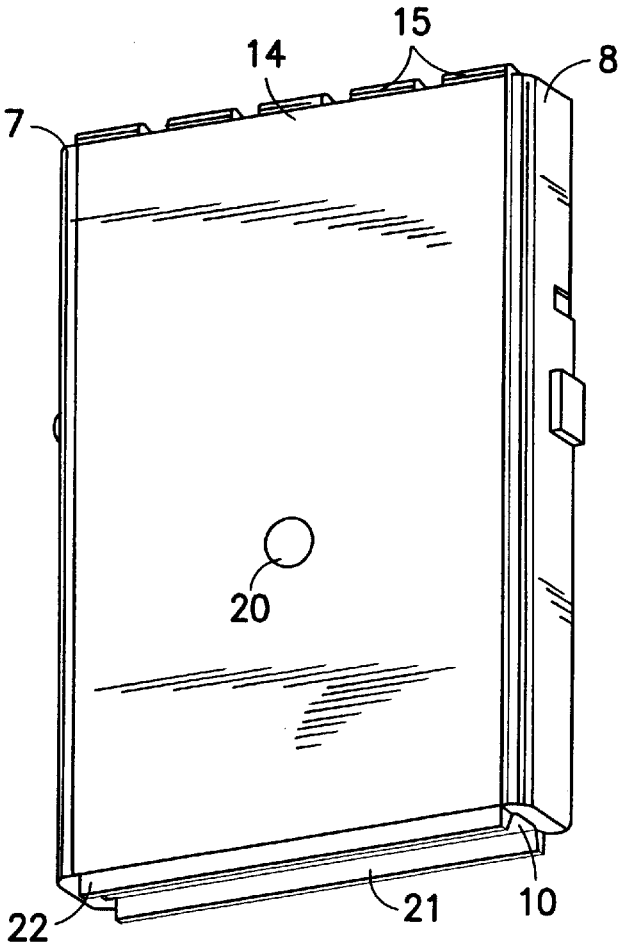

FIG. 5 is a perspective back view of the module of FIG. 4.

Figure 6:
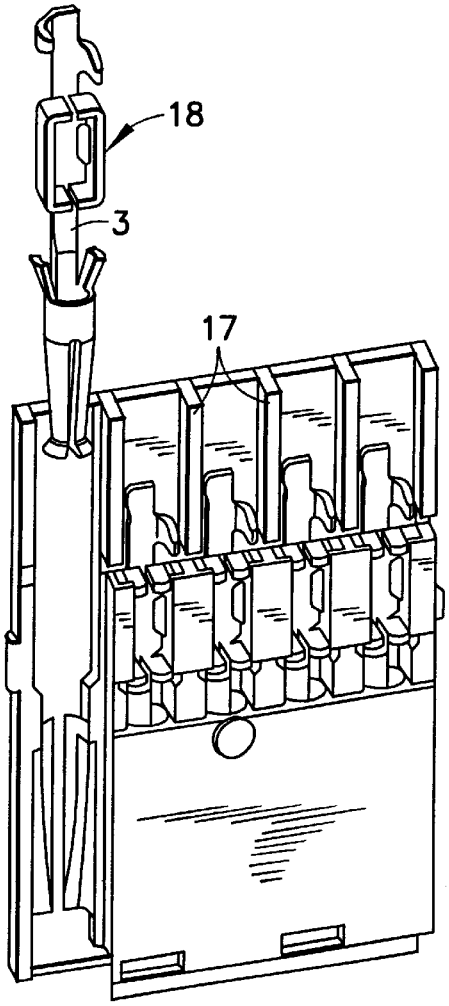

FIG. 6 shows the module of FIG. 4 partly broken away, wherein an electrical contact element is shown as partially inserted in the corresponding channel.

Figure 7:
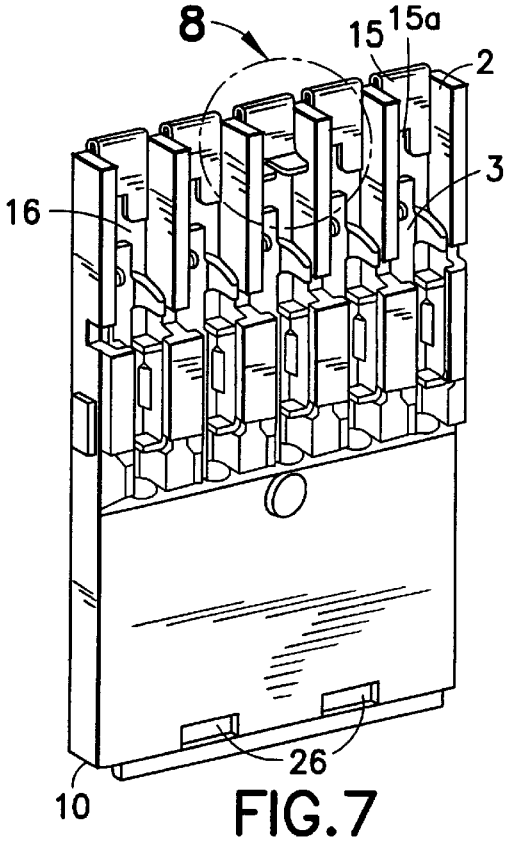

FIG. 7 is a perspective view of the module of FIG. 4, wherein a detachable cover plate has been removed.

Figure 8:
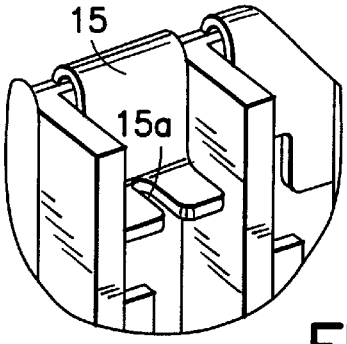

FIG. 8 shows a detail of FIG. 7 at a larger scale.

Figure 9:
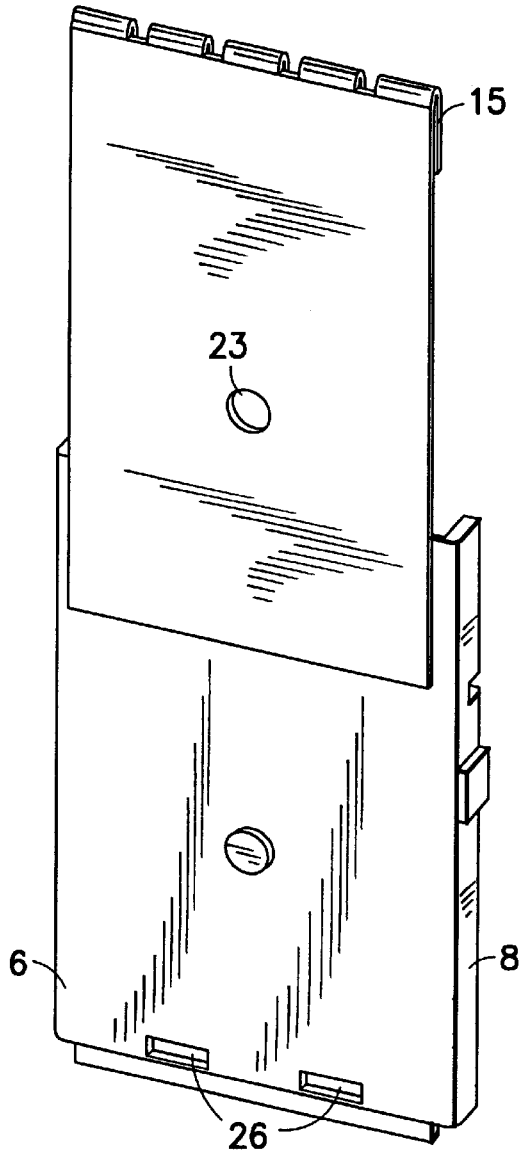

FIG. 9 shows a perspective back view of the module of FIG. 7, wherein the shielding plate is shown separated from the housing of the module.

Figure 10:
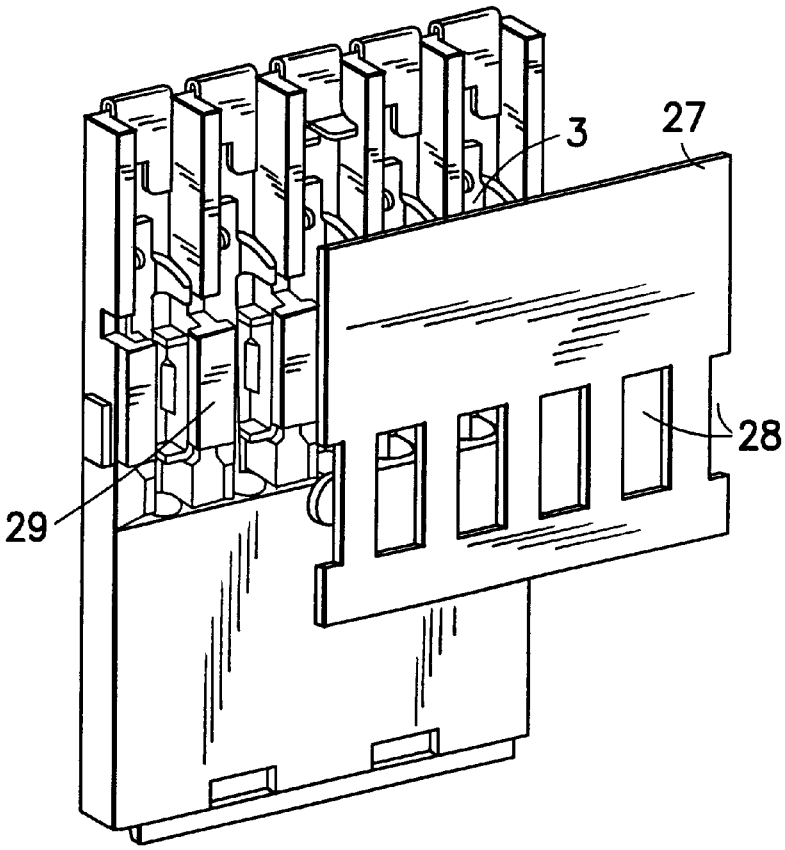

FIG. 10 is a perspective view of the module of FIG. 4 with detached cover plate.

Figure 11:
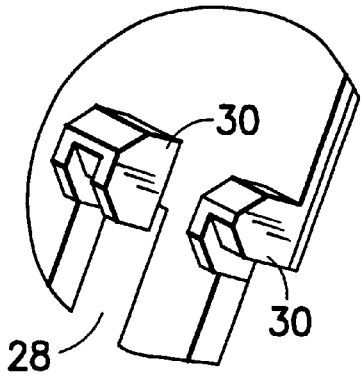

FIG. 11 shows a detail of the cover plate of FIG. 10.

DETAILED DESCRIPTION OF THE INVENTION

FIG. 1 shows a perspective view of a connector 1 for a shielded cable not shown, comprising for example a plurality of co-axial and/or twin-axial cables. The connector 1 comprises an assembly of modules 2, in this case four, which are shown in more detail in FIGS. 2–11. The connector 1 further comprises electrical contact elements 3 arranged in rows and columns and shown in more detail in FIG. 6. The modules 2 each comprise a housing 4 of insulating material and electrical contact elements 3 received in this housing 4 and arranged next to each other in a side-by-side relationship, or in a column direction. In a similar manner, the aligned contact elements 3 in successive housings 4 are said to comprise a row.

As shown in the drawings, each housing 4 is mainly box-shaped with a front wall 5, a back wall 6 and intermediate sidewalls 7, 8 and an open upper side 9 and an open lower side 10. A common plate 11 with insert openings 12 joins the lower side 10, wherein the insert openings 12 align the contact pins of a complementary connector not shown with the contact elements 3 accommodated in the connector. The plate 11 is also made of insulating material.

The connector 1 described is intended in particular for use at high frequency signals, wherein the shielding is important. To this end the assembly of modules 2 is mounted in a metal housing 13 as is conventional for such applications. Moreover in the connector described each module 2 is provided with its own shielding plate 14 for this purpose which is mounted on the back wall 6. The shielding plate 14 is provided at its upper end with in this case five bent lips 15 which engage around the upper edge of the back wall 6 in the manner as shown in FIGS. 7–9 and thereby hold the shielding plate 14 on the back wall 6.

Each lip 15 projects from the open upper side 9 downwardly into a channel 16 of the housing 4, adjacent channels 16 being separated from each other by intermediate walls 17. A contact element 3 is received in each channel 16. Each lip 15 is provided with a slot 15*a*, flaring outwardly towards the end of the lip. By bending as desired one of the lips 15 along substantially 90° in the manner shown in FIGS. 7 and 8, a ground terminal of the so-called IDC-type is obtained, to which a ground conductor of a twin-axial cable for example can be connected simply by pressing the same into the slot 15*a*. Thereby the ground conductor of the corresponding twin-axial cable is connected to the shielding plate 14.

In the embodiment described of the connector 1 a simple connection of the contact element 3 of the corresponding channel is further obtained, in that each contact element 3 is also provided with an IDC-terminal 18 which is aligned with the IDC-terminal provided by the lip 15 if the lip is bent along 90°. The ground conductor can be pressed simply into the slots of the IDC-terminal 15 and the IDC-terminal 18.

The construction described of the shielding plate 14 with lips 15 shows the advantage that as desired an IDC ground terminal can be realised in each channel 16 by bending the corresponding lip 15 in the operative position shown in FIG. 8 in detail, whereas in the other channels 16 the lips 15 are remaining flat against the inner side of the back wall 6 in an inoperative position. Moreover the IDC-terminals 15 are obtained at a small distance between the terminals of 2 mm for example.

It is noted that the drawings show a preferred embodiment. If desired the lips 15 could be part of a conductive strip which is connected to a shielding of the housing 4 in a manner not shown.

FIGS. 4 and 5 show that both on the front wall 5 and on the back wall 6, lugs 19, 20, respectively, are formed which are circular in this case. In line with the front wall 5 and the back wall 6 ledges 21, 22, respectively, are provided. The lugs 19, 20 and ledges 21, 22 are raised with respect to the outer surface of the front wall 5 and back wall 6, respectively, and are located in such a manner with respect to the walls 5, 6 that when a module is located with its front wall 5 against the back wall 6 of a previous module 2, the lug 19 and ledge 21 opposingly engage respectively, the lug 20 and the ledge 22. The width of a housing 4 of a module 2 is determined by the lugs 19,20 and ledges 21,22 and thereby also the pitch between the contact elements 3 of successive modules of the connector 1. When in particular these parts 19–22 are manufactured accurately, the pitch between successive rows of contact elements can be determined accurately.

As can be seen in FIG. 1, the lugs 19, 20 and the ledges 21, 22 project beyond the corresponding outer surface of the metal housing 13 so that also with successive connectors 1 the corresponding lugs and ledges opposingly engage each other. Thereby two or more connectors can be inserted one next to the other into a complementary connector, wherein the pitch, or distance between the contact elements 3 of successive connectors 1, is determined by the lugs and ledges 19–22. The lugs 19, 20 each provide one supporting point and the ledges 21,22 each provides a supporting line, the supporting locations defined by the supporting points and the supporting lines determining the pitch between successive contact elements 3.

As shown in FIG. 9, the shielding plate 14 is provided with an opening 23 for receiving the lug 20, wherein the thickness of the shielding plate 14 taking into account the manufacturing tolerances, is chosen such that the lug 20 always projects with respect to the outer surface of the shielding plate 14. The same applies to the ledge 22. The ledge 22 also prevents that the shielding plate 14 can be bent away unintendedly from the back wall 6 at the lower side of the housing 4, for example by a contact pin during insertion of the connector in an incorrect manner.

The common plate 11 is provided with slots 24 at both sides of a column of insert openings 12 for a module 2, wherein the ledges 21,22 can be received in these slots. The outer slots 24 as seen on row direction are sideways open, so that the corresponding ledges 21,22 determine the width of the connector. As shown in FIG. 1, a common plate 11 is located at the lower side just outside the metal housing 13. Lugs 25 of the plate 11 engage in two openings 26 of the modules 2 located at the outer side and thereby fix the plate 11 on the assembly of modules 2.

It is noted that the module 2 shown in FIG. 3 at the rear is made without shielding plate 14, because at that side the metal housing 13 provides the shielding of this module.

FIGS. 10 and 11 show more in detail that the front wall 5 of the housing 4 of a module 2 comprises a detachable cover plate 27, which provides access to the IDC-terminals 15,18 when removed Windows 28 are made in the cover plate 27, for receiving strips 29 when the cover plate is mounted on the module 2, said strips 29 being made on the side walls 7,8 and intermediate walls 17. In FIG. 11 lugs 30 can be seen which engage behind these strips 29 to thereby hold the cover plate 27 on the housing 4.

The invention is not restricted to the above-described embodiment which can be varied in a number of ways within the scope of the claims.

What is claimed is:

1. An electrical connector for a shielded cable, comprising an assembly of at least two adjacent modules and electrical contact elements arranged in parallel rows defining a row direction and in parallel columns defining a column direction, wherein each module is provided with a housing of insulating material and electrical contact elements received in the housing and arranged next to each other in the direction of the columns, wherein each housing is mainly box shaped with a front wall, a back wall, sidewalls lying therebetween, an open upper side and an open lower side, wherein channels extend between the open upper and open lower sides, said channels being separated from each other by intermediate walls, and the contact elements being received in said channels, wherein one housing with its front wall adjoins the back wall of a next housing, characterized in that in each housing the front and back walls are provided with corresponding supporting points defining supporting locations, said supporting locations of adjacent modules being opposingly engaged, respectively, said supporting locations determining the distance in the direction of the rows between the contact elements of adjacent housings, wherein at least one housing is provided with a metal shielding plate mounted on the back wall thereof without interfering with the supporting locations of the back wall, wherein each housing is provided with a longitudinal ledge extending along an edge at its lower side in line with the front wall or the back wall, said ledge projecting with respect to the front or back wall, respectively, and determining one of the supporting locations, and wherein a plate with insertion openings is provided, common to the assembly of modules, said insertion openings joining the channels in the housings of adjacent modules, and a slot is provided in the plate for receiving said longitudinal ledge.

2. An electrical connector according to claim 1, wherein at each side of the insertion opening of the plate having a slot for receiving each ledge of the housing, wherein the slots for the outer ledges are open sideways, the ledges extending in a row direction with respect to the common plate and engageable with the plate to thereby determine the width of the connector.

3. An electrical connector according to claim 1, wherein the front wall of each housing comprises a detachable cover plate connected to the housing by mutually engageable lugs on the cover plate and on the housing.

4. An electrical connector according to claim 1, wherein each shielding plate is provided with bent lips, the shielding plate being mounted to the back wall by slidable engagement of said lips with the back wall, each lip projecting into a corresponding channel of the housing.

5. An electrical connector according to claim 4, wherein each metal shielding plate is provided with an opening for receiving therethrough the supporting location of the back wall.

6. An electrical connector according to claim 1, wherein the assembly of modules is received in a metal housing and includes a shielding plate mounted between opposite front and back walls of each housing having an opening for receiving therethrough a supporting location of the front and back wall respectively of the adjacent housings in such a manner that the supporting locations of the modules within the metal housing determine the distance between the contact elements in the openings of adjacent modules.

* * * * *